US005936511A

United States Patent [19]

Kawamoto et al.

[11] Patent Number: 5,936,511

[45] Date of Patent: Aug. 10, 1999

[54] ELECTRONIC DEVICE HAVING LEAD TERMINALS COATED WITH RESIN

[75] Inventors: Tetsuya Kawamoto; Tatsuya Yoshimura; Yoshiyuki Yamashita, all of Shiga, Japan

[73] Assignee: Murata Manufacturing Co., Ltd., Kyoto, Japan

[21] Appl. No.: 08/781,197

[22] Filed: Jan. 10, 1997

[30] Foreign Application Priority Data

Jan. 22, 1996 [JP] Japan ..... 7-008665

[51] Int. Cl.[6] ..... H01C 7/10

[52] U.S. Cl. ..... 338/22 R

[58] Field of Search ..... 338/22 R, 22 D; 392/503; 374/185; 310/320, 340, 348

[56] References Cited

U.S. PATENT DOCUMENTS

| | | | |
|---|---|---|---|
| 4,129,557 | 12/1978 | Kudo | 526/283 |
| 4,589,010 | 5/1986 | Tateno et al. . | |
| 4,617,585 | 10/1986 | Yasui . | |
| 5,073,533 | 12/1991 | Aono | 503/227 |
| 5,166,570 | 11/1992 | Takahashi et al. | 310/320 |
| 5,372,427 | 12/1994 | Padovani | 374/185 |
| 5,464,724 | 11/1995 | Akiyama | 430/272 |
| 5,483,145 | 1/1996 | Shiojima | 320/35 |
| 5,496,677 | 3/1996 | Toyama | 430/162 |
| 5,580,493 | 12/1996 | Chu | 252/511 |
| 5,585,710 | 12/1996 | Nakamura | 320/15 |

FOREIGN PATENT DOCUMENTS

| | | |
|---|---|---|
| 3418623 | 5/1984 | Germany . |
| 1-159906 | 12/1987 | Japan . |
| 4-191046 | 11/1990 | Japan . |
| 07141924 | 11/1993 | Japan . |

*Primary Examiner*—Teresa Walberg
*Assistant Examiner*—Jeffrey Pwu
*Attorney, Agent, or Firm*—Majestic, Parsons, Siebert & Hsue P.C.

[57] ABSTRACT

An electronic device of a kind having an electronic element with a main body, terminal electrodes on the main body and lead terminals electrically connected individually to the terminal electrodes has at least a portion of the outer surfaces of the lead terminals covered with a coating resin composition containing as its resin component a saturated copolymerized polyester resin which can be dissolved in an organic solvent such that the mechanical strength of the lead terminals is improved and the insulation of the device is not compromised during its manufacture or mounting.

20 Claims, 1 Drawing Sheet

ELECTRONIC DEVICE HAVING LEAD TERMINALS COATED WITH RESIN

BACKGROUND OF THE INVENTION

This invention relates to an electronic device, such as a negative-characteristic thermistor, having lead terminals with the outer surfaces coated with a resin material for improved mechanical strength.

Electronic devices of the kind having an electronic element covered with a resin material or the like for protection against the external environment have been widely in use. In the case of a device with lead terminals, the terminals, too, are sometimes covered for improving electrical insulation. For covering a lead terminal longitudinally, a material having a silicone rubber resin as its principal component may be used to coat it from outside, or the lead terminal may be inserted into a preliminarily formed tube made, for example, of cross-linked polyolefin.

Prior art lead terminals which are thus coated, however, have had problems of various types. In the case of a lead terminal covered with a silicone rubber type resin material, the coating film is easily damaged or peeled off when an external force such as a scratching force is applied on the lead terminal during its fabrication process, whether it is done by a machine or manually. In the case of a lead terminal covered with a preliminarily formed tube, the cost of manufacturing the tube is considerable, and the production involves an extra process of inserting the terminal into the tube. In addition, an uncovered gap may be left between the externally covered main body of the electronic element and the lead terminal covered with a tube such that the electrical insulation of the device may be compromised.

SUMMARY OF THE INVENTION

It is therefore an object of this invention to provide electronic devices of the kind having an electronic element with lead terminals covered externally by a resin composition, capable of maintaining its electrically insulated condition reliably even if an external force such as a scratching force is applied thereon.

An electronic device embodying this invention, with which the above and other objects can be accomplished, may be characterized as comprising an electronic element having a main body, terminal electrodes formed on the main body and lead terminals in electrically conductive relationship with the lead terminals, and a coating resin composition which covers at least a portion of the outer surfaces of the lead terminals, having as its resin component a saturated copolymerized polyester resin which can be dissolved in an organic solvent. The coating resin composition may be applied so as to cover the outer surfaces of both the main body of the electronic element and the lead terminals. The invention is particularly effective if the lead terminals are bent at least at one position where it is covered with the coating resin composition. From the point of view of use, this invention is particularly effective if the electronic device contains a thermistor with a negative characteristic, and it is even further effective when it is used for the detection of the temperature of a secondary battery in a pack comprising secondary batteries and a main body which houses these batteries.

The coating resin composition according to this invention may preferably contain an organic flame retardant and also isocyanate as a hardening agent.

The coating resin composition according to this invention comprises saturated copolymerized polyester resin which can be dissolved in an organic solvent. Such saturated copolymerized polyester resin may be of a kind having average numerical molecular weight of 18000–25000, tensile rupture strength 2 MPa–20 MPa, tensile rupture elongation 300%–1400%, and hardness 15 Shore D–60 Shore D. Alternatively, it may be of another kind having average numerical molecular weight of 15000–20000, tensile rupture strength 35 MPa–60 MPa, tensile rupture elongation 1%–10%, and hardness 65 Shore D–90 Shore D. It may also contain both of these kinds. It has been ascertained that coating resin compositions of this invention having tensile rupture strength 12 MPa–20 MPa, tensile elastic modulus 500 MPa–1200 MPa, tensile rupture elongation 3%–40%, and hardness 42 Shore D–50 Shore D have particularly desirable characteristics.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

The invention will be described first with reference to an example but it goes without saying that this example is not intended to limit the scope of the invention.

Figure 1:
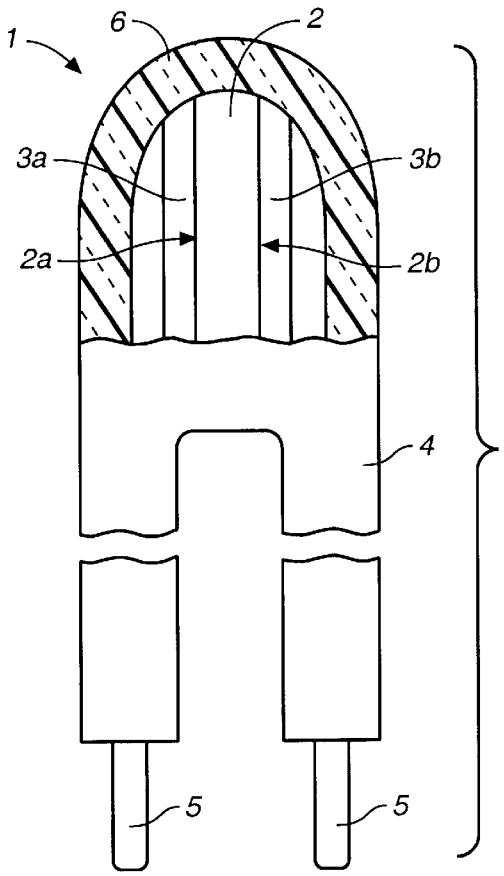
FIG. 1 is an external view of an electronic device embodying this invention with a portion removed.

FIG. 1 shows an electronic device 1 embodying this invention comprising a planar thermistor 2 with a negative characteristics having two outwardly facing mutually parallel principal surfaces 2*a* and 2*b*, a pair of terminal electrodes 3*a* and 3*b* each disposed on a different one of these principal surfaces 2*a* and 2*b*, lead terminals 5 each with one end soldered to a corresponding one of the terminal electrodes 3*a* and 3*b* to be electrically conductive therewith and the other end protruding out of a coating resin composition 4 and a covering resin material 6 comprising, for example, an epoxy resin applied and hardened so as to cover the thermistor 2 inclusive of its two principal surfaces 2*a* and 2*b*. The entire external surface of this electronic device 1 is coated with the coating resin composition 4. The lead terminals 5, too, are entirely coated with the coating resin composition 4 except at "the other ends" which protrude from the coating resin composition 4 for making connections to a circuit board (not shown).

Figure 2:
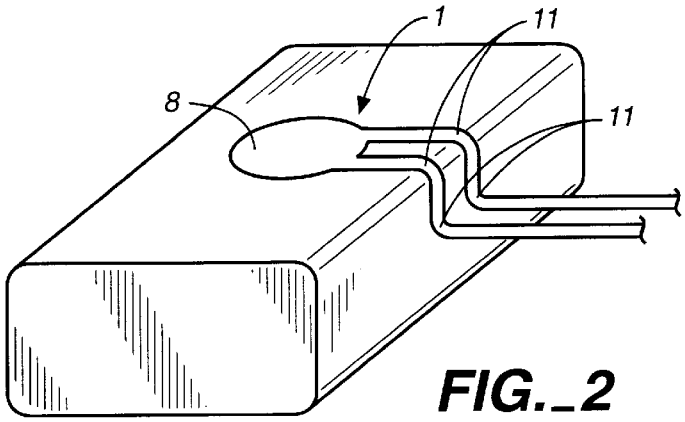
FIGS. 2 and 3 are external views of the electronic device of FIG. 1 being used for detecting the temperature of secondary batteries with different external shapes.
Figure 3:
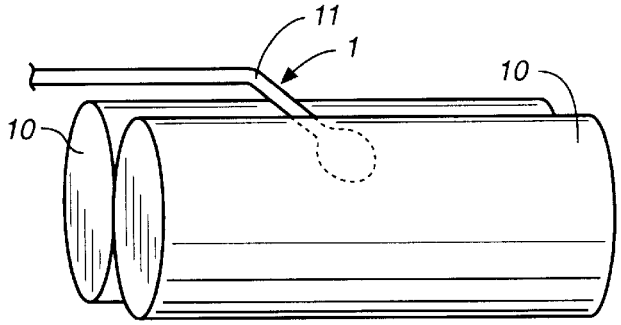

When the electronic device 1 as described above is used for detecting the temperature of a secondary battery pack, it may partially look as shown in FIG. 2 or 3, FIG. 2 showing a situation where the device 1 is being used for the detection of the temperature of a rectangular columnar secondary battery 8 and FIG. 3 showing another situation where it is being used for the detection of the temperature of a circular cylindrical secondary battery 10. Bent parts 11 shown in FIGS. 2 and 3 are formed according to the shape of the secondary battery 8 or 10 which is the target of temperature detection, as well as the wiring of the electronic device. Although not shown in FIG. 2 or 3, a main body of the battery pack is formed by arranging a plurality of secondary batteries as shown in FIG. 2 or 3 either longitudinally or sideways and sealing them by surrounding them both from above and from below. Connector terminals (not shown)

provided on the inner peripheral edge of this battery pack main body and the electronic devices 1 are electrically connected, and each electronic device 1 is arranged according to the corresponding one of the secondary batteries 8 and 10 such that the corresponding secondary battery 8 or 10 will be in contact with the neighborhood of the upper part of its thermistor 2 with a negative characteristic.

Next, the coating resin composition 4 will be described in detail. Table 1 describes the coating resin compositions for Examples Nos. 1–7, as well as their physical characteristics and results of experiments.

TABLE 1

| Example | No. 1 | No. 2 | No. 3 | No. 4 | No. 5 | No. 6 | No. 7 |
|---|---|---|---|---|---|---|---|
| Resin A | 100 | 100 | 100 | 75 | 50 | 25 | 0 |
| Resin B | 0 | 0 | 0 | 25 | 50 | 75 | 100 |
| Inorganic Filler A | 0 | 165 | 165 | 165 | 165 | 165 | 0 |
| Inorganic Filler B | 0 | 12 | 12 | 12 | 12 | 12 | 0 |
| Organic Flame Retardant | 0 | 0 | 24 | 24 | 24 | 24 | 0 |
| Physical Characteristics | | | | | | | |
| Tensile Rupture Strength | 2.1 | 6.9 | 7.5 | 12.5 | 17.8 | 19.2 | 21.0 |
| Tensile Elastic Modulus | 3.9 | 102.1 | 105.2 | 500.5 | 912.6 | 1150.3 | 571.4 |
| Tensile Rupture Elongation | 973 | 81 | 75 | 40 | 5 | 3 | 1 |
| Hardness | 8 | 40 | 40 | 42 | 44 | 50 | 65 |
| Evaluation of Characteristics | | | | | | | |
| Bending | 0:A | 0:A | 0:A | 0:A | 0:A | 0:A | 0:A |
| Pulling Out (N) | 4.0:C | 10.0:A | 10.0:A | 12.5:A | 15.0:A. | 15.0:A | 15.0:A |
| Splitting | 0:A | 0:A | 0:A | 0:A | 0:A | 0:A | 0:A |
| Ultrasonic Load | 10:C | 0:A | 0:A | 0:A | 0:A | 0:A | 0:A |
| Flame Resistance UL95 | <V-2:C | ≈V-1:B | ≈V-0:A | ≈V-0:A | ≈V-0:A | ≈V-0:A | <V-2:C |

In Table 1, Resin A is a material obtained by mixing suitable amounts of blocked isocyanate (trimer of hexamethylene diisocyanate) as a hardening agent and a hardening accelerator containing an organic tin compound with a saturated polyester resin (with average numerical molecular weight of 20000–25000, tensile rupture strength of 2 MPa–8 MPa, tensile rupture elongation of 500%–900%, hardness of 20 Shore D–30 Shore D, and melt index greater than 250 g/10 min) serving as the base resin. Resin B is another material obtained by mixing suitable amounts of blocked isocyanate (trimer of hexamethylene diisocyanate) as a hardening agent and a hardening accelerator containing an organic tin compound with a saturated polyester resin (with average numerical molecular weight of 18000–20000, tensile rupture strength of 35 MPa–55 MPa, tensile rupture elongation of 1%–7%, hardness of 70 Shore D–85 Shore D, and melt index greater than 200 g/10 min) serving as the base resin. In the description given above of the physical 20 characteristics of the base resins of Resins A and B, molecular weights are expressed by the VPO method, tensile rupture strength and tensile rupture elongation according to ASTM-D638-61T, hardness according to ASTM-D-2240 and melt index according to ASTM-D-1238 (temperature 300° C., load 2160 g). As Inorganic Filler A, use was made of aluminum hydroxide (trade name CE-300A, produced by Sumitomo Kagaku Kogyo Co., Ltd.) As Inorganic Filler B, use was made of antimony trioxide (trade name ATOX-S, produced by Nihon Kogyo Co., Ltd.) As Organic Flame Retardant, use was made of hexabromobenzene (trade name AFR1001, produced by Asahi Garasu Co., Ltd.)

Measurements of tensile rupture strength, tensile elastic modulus and tensile rupture elongation were carried out (for Table 1) all according to JIS-K-6251 (with the use of dumb-bell-shaped No. 2), and hardness was measured according to ASTM-D-2240. In Table 1, "A" indicates "Very good", "B" indicates "Good", and "C" indicates "Usable" although not as good as "B".

For the measurement of the strength against bending ("bending strength"), the lead terminal was bent by about 90° and then straightened back, and this was repeated for two cycles. Thereafter, the device was dipped in water inside a beaker, including the bent part of the lead terminal. Another metallic electrode was dipped in the water, and a DC voltage of 50 V was applied for one minute between the lead terminal and the metallic electrode and the leak current was measured to evaluate the condition of insulation. It was "Good" if the leak current was less than 1 mA. The number of samples, out of ten thus tested, with a leak current exceeding 1 mA is shown in Table 1.

For the measurement of resistive force against pulling the lead line output of its cover ("pulling-out strength"), the lead line was placed on a table, a specified pressure was applied thereon in a direction perpendicular to the lead line through a pressuring plate (with radius R=0.5 mm), and the lead line was pulled out in one direction at the speed of 2 mm/sec. The leak current was measured thereafter as described above to determine the condition of insulation. The pressure (in units of N) at which all ten tested samples were found to be well insulated is shown in Table 1.

For the measurement of strength against splitting the lead terminals apart ("splitting strength"), one of the two lead lines was fastened and the other lead line was pulled in the direction away from the fastened lead line. The load was gradually increased, and the appearance was visually observed after it was kept for 10 seconds at 2.5N. The number of samples, out of ten tested samples, which showed abnormality in appearance is shown in Table 1.

For the measurement of ultrasonic load strength, two electronic devices were placed on an ultrasonic vibrator table such that their lead terminals crossed and a 30×30 mm pressuring plate was used to press from above the crossed area at 6N. The ultrasonic vibrator table was vibrated with frequency 19 kHz and amplitude of about 5–8$\mu$m. Application of pressure was for 10 seconds, and the leak current was measured thereafter as explained above to determine the condition of insulation. The number of samples, out of ten thus tested, with a leak current exceeding 1 mA is shown in Table 1.

Next, the observed characteristics of Test Examples Nos. 1–7 will be explained.

Test Example No. 1 was very good regarding its bending strength and splitting strength but it was inferior to the other test examples regarding the pulling-out strength, ultrasonic load strength and flame resistance UL94 although it was still within the range of being usable. This was because Resin A is relatively soft, having a high tensile rupture elongation. Although it can easily withstand external forces for bending and splitting, it is not sufficiently strong against external forces for scratching or ultrasonic load strength although it is still practically usable. Since Test Example No. 1 contains nothing but a resin, its flame resistance is such as to make it acceptable for practical use but is not sufficiently high.

Test Example No. 2 was very good regarding its bending strength, pulling-out strength, splitting strength and ultrasonic load strength, and it was also good regarding flame resistance UL94. It was because use was made of an inorganic filler. The pulling-out strength and the ultrasonic load strength improve as the tensile rupture strength and hardness improve. The addition of an inorganic filler also contributes to improvement of flame resistance, and its flame resistance according to the UL94 standard was an equivalent (indicated by "≈" in Table 1) of V-1.

Test Example No. 3 exhibited a further improvement in flame resistance because an organic flame retardant was added in addition to the components of 10 Test Example No. 2. Its flame resistance according to UL94 was an equivalent of V-0.

Test Examples Nos. 4–6 were all very good regarding bending strength, pulling-out strength, splitting strength, ultrasonic load strength and flame resistance UL94. It was because relatively soft and relatively hard Resins A and B were mixed together. Pulling out strength and ultrasonic load strength further improve as tensile rupture strength and hardness improve. The characteristics of a device are seen to improve as the ratio of Resin B is increased.

Test Example No. 7 was also very good regarding bending strength, pulling-out strength, splitting strength and ultrasonic load strength but was inferior to the other Test Examples regarding flame resistance UL94 although it was still acceptable for practical use. It is because Resin B is relatively hard, having high tensile rupture strength and high hardness, and it can hence withstand external forces for bending, splitting and pulling out as well as an ultrasonic load. Since Test Example No. 7, like Test Example No. 1, contains nothing but a resin, its flame resistance is such as to make it acceptable for practical use but is not sufficiently high.

In summary, Test Examples Nos. 1–7 are all very good regarding bending strength and splitting strength such as to easily satisfy the objects of this invention. Test Examples Nos. 2–7 are very good also regarding pulling-out strength and ultrasonic load strength and hence are superior for practical purposes. If flame resistance is also taken into consideration, Test Examples Nos. 3–6 are particularly good.

Although the invention has been described above with reference to test examples incorporating a thermistor with negative characteristic, an electronic device of this invention may be described more generally as comprising an electronic element having a main body, terminal electrodes formed on the main body and lead terminals in electrically conductive relationship with the lead terminals, and a coating resin composition which covers at least a portion of the outer surfaces of the lead terminals, having as its resin component a saturated copolymerized polyester resin which can be dissolved in an organic solvent such that the device can be subjected to a lead terminal fabrication process generating a strong external scratching force thereon without causing defects on the externally coating film or compromising its electrical insulation. Thus, as shown by way of examples above, devices according to this invention have improved pulling-out strength and ultrasonic load strength and hence are usable without any problem even in situations where relatively severe conditions exist. They also have improved bending strength and splitting strength such that they may be bent repeatedly at a same position or the lead terminals may be bent away from each other where they are attached to the electronic element.

Since at least a portion of the outer surfaces of the lead terminals is coated, electrical insulation of the lead terminals can be reliably maintained where insulation is particularly important. If the outer surfaces of the lead terminals are completely coated except at the parts adapted to be attached to a circuit board, say, by soldering, resistance against external mechanical forces, as well as insulation, can also be improved.

In order to fully take advantage of the coating resin composition according to this invention, the coating resin composition should be applied to coat the parts of the device with the lead terminals. Its electronic element itself need not necessarily be coated. The outer surfaces of both the electronic element and the lead terminals may be coated at the same time in the process of applying the coating resin composition.

This invention is particularly effective for electronic devices with lead terminals which are bent at least at one position. It is because the coating resin composition according to this invention has superior bending strength and splitting strength. Since the bent parts, too, are completely covered with the coating resin composition even after the manufacturing processes, defects such as cracks and peeling do not take place. Lead terminals are often required to be bent at different angles or pulled away from each other when, for example, they must be connected to terminals which are separated far apart. Electrical insulation at such bent parts is a serious problem, and this invention is successfully addressed to this problem.

This invention does not place any limitation on what is inside the main body of the electronic device and hence can be used for many different purposes. The main element of the device may be a planar capacitor or a thermistor. If it is a thermistor, it must preferably be placed near the component of which the temperature is to be detected accurately, and this may require the lead terminals to be bend at different angles and/or away from each other, depending on the structure and wiring of the target component. When the device is being placed in contact with the target component, furthermore, the device may take the risk of being scratched. The present invention is addressed also to situations like this, preventing defects associated with the bending and splitting of the lead lines.

The saturated copolymerized polyester resin, used in the present invention, can be dissolved easily in organic solvents because they contain non-crystalline saturated polyester resin. Thus, the coating resin compositions according to this invention can form a covering film on the outer surfaces of electronic elements and lead terminals by a so-called dipping process, or by removing the organic solvent with a shower or a spray method to coat and heat the electronic element, or by adding a hardening agent to cause thermosetting.

It is preferable that an inorganic filler be added to the coating resin composition of this invention. Such addition contributes to an improvement in the strength of the coating resin composition such as its pulling-out strength and ultrasonic load strength. Such a filler may be added also for improving flame resistance.

Pulling-out strength is not always necessary in an electronic device, but electronic devices are often scratched when being handled, for example, by contacting another objects. Especially if the electronic device is a thermistor, it must be contacted with its target object for the purpose of its use and an improved pulling-out strength is desirable. Similarly, ultrasonic load strength is not always necessary in an electronic device, but if the electronic device is a thermistor which is used for the detection of temperature of a secondary battery pack, for example, an improved ultrasonic load strength is desirable such that there is sufficient insulation at the time of ultrasonic bonding when the secondary battery pack is assembled.

The aforementioned inorganic filler may be in the form of single-component powder or mixed powder as long as it contains at least one selected from metallic oxides such as silicon oxide, titanium oxide, aluminum oxide, talc and antimony trioxide and metallic hydroxides such as aluminum hydroxide and magnesium hydroxide. Particularly preferable examples are those containing metallic hydroxide such as aluminum hydroxide and magnesium hydroxide or antimony oxide such as antimony trioxide. They are preferable from the point of view of improved flame resistance.

The amount of such an inorganic filler to be contained does not limit the scope of the invention. It is added such that the pulling strength and ultrasonic load strength of the lead terminals covered by the coating resin composition be sufficiently high for practical use. The preferred content is 10–400 weight parts against 100 weight parts of the resin component to be described below. If the content is less than 10 weight parts, the resin component tends to peel off during a test for the ultrasonic load strength. If the content exceeds 400 weight parts, on the other hand, the workability is adversely affected at the time of the coating operation and cracks are likely to be generated during a bending test and a splitting test.

It is further preferred that the coating resin composition of this invention additionally contain an organic flame retardant in order to further improve the flame resistance. Examples of such organic flame retardant include hexabromobenzene, pentabromodiphenylethane, ammonium polyphosphate and polyphosphoric amide.

From the point of view of the primary objects of this invention, flame resistance is not a required characteristic. Thus, flame resistance may be considered only according to the particular situation of the use. Thus, the content of the organic flame retardant does not limit the scope of this invention but it is preferably 5–50 weight parts against 100 weight parts of the resin component. If the content is less than 5 weight parts, an equivalent of V-0 according to the UL94 standard cannot be obtained. If the content exceeds 50 weight parts, on the other hand, it is not desirable because the characteristics against humidity, for example, are adversely affected.

It is preferred that isocyanate be used as a hardening agent for the coating resin composition of this invention. The addition of isocyanate is advantageous for improving anti-chemical property because isocyanate cross-links with the carboxyl or hydroxyl group which is an end group of the aforementioned saturated copolymerized polyester resin. Preferred examples of isocyanate include those transformed to a trimer having blocked isocyanate group.

Examples of the saturated copolymerized polyester resin dissolvable in an organic solvent used in this invention include those (Resin A) having average numerical molecular weight of 18000–25000, tensile rupture strength 2 MPa–20 MPa, tensile rupture elongation 300%–1400%, and hardness 15 Shore D–60 Shore D. As can be predicted from these limitations, such saturated copolymerized polyester resins are relatively soft and hence effective in improving the bending strength and splitting strength of the lead terminal parts.

Examples of the saturated copolymerized polyester resin dissolvable in an organic solvent used in this invention also include those (Resin B) having average numerical molecular weight of 15000–20000, tensile rupture strength 35 MPa–60 MPa, tensile rupture elongation 1%–10%, and hardness 65 Shore D–90 Shore D. As can be predicted from these limitations, such saturated copolymerized polyester resins are relatively hard and hence effective in improving the pulling-out strength and ultrasonic load strength of the lead terminal parts.

Examples of the saturated copolymerized polyester resin dissolvable in an organic solvent used in this invention further include mixtures of those (Resin A) having average numerical molecular weight of 18000–25000, tensile rupture strength 2 MPa–20 MPa, tensile rupture elongation 300%–1400%, and hardness 15 Shore D–60 Shore D and those (Resin B) having average numerical molecular weight of 15000–20000, tensile rupture strength 35 MPa–60 MPa, tensile rupture elongation 1%–10%, and hardness 65 Shore D–90 Shore D. If the relative contents of these two kinds of saturated copolymerized polyester resins are adjusted, it is possible to obtain a coating resin composition with very good characteristics including bending strength, splitting strength, pulling-out strength, ultrasonic load strength and flame resistance, capable of further improving the coating films. It is preferable to mix 25–75 weight parts of Resin B with 100 weight parts of Resign A. With this mixing ratio, the ultrasonic load strength is particularly improved.

It is preferred that the coating resin composition according to this invention have tensile rupture strength 12 MPa–20 MPa, tensile elastic modulus 500 MPa–1200 MPa, tensile rupture elongation 3%–40%, and hardness 42 Shore D–50 Shore D. Coating resin compositions within this range can satisfy all of the requirements described above. Within the limit that their desired characteristics are not adversely affected, the coating resin compositions of this invention may also contain a hardening accelerator, a modifier (or a reforming agent), a coloring pigment, a thixotropy providing agent, an anti-foaming agent and an organic solvent capable of dissolving Resins A and B.

The method of producing such a coating resin composition is not intended to limit the scope of this invention. These components described above may be simply mixed and kneaded together. A coating resin composition thus produced may be dissolved in an organic solvent, for example, to an appropriate degree and applied to the outer surfaces of the main body of an electronic device as well as its lead terminals by dipping. It may then be heated at 120°–180° (such as 150° C.) for 30–180 minutes (such as 90 minutes) to be cured and to produce an electronic device with a film having a thickness of 0.03 mm–0.80 mm (such as 0.05 mm–0.20 mm). End portions of the lead terminals adapted for connection with a circuit board are not coated with the coating resin.

In summary, electronic devices according to this invention have lead terminals with improved mechanical strength such that damages are not likely to be sustained by external forces exerted thereon when they are manufactured or mounted and their insulation will be not compromised. The description of the invention given above is intended to be interpreted broadly, and such modifications and variations of the disclosure that may be apparent to a person skilled in the art are intended to be within the scope of the invention.

What is claimed is:

1. An electronic device comprising:

a planar thermistor main body having mutually parallel outwardly facing principal surfaces, terminal electrodes on said principal surfaces and lead terminals each connected to and in electrically conductive relationship with a corresponding one of said terminal electrodes;

a covering resin material which comprises epoxy resin and covers said thermistor main body; and a coating resin composition covering at least a portion of outer surfaces of said lead terminals, said coating resin composition containing as resin component thereof a saturated copolymerized polyester resin which can be dissolved in an organic solvent.

2. The electronic device of claim 1 wherein said coating resin composition covers outer surfaces of both said thermistor main body and said lead terminals.

3. The electronic device of claim 1 wherein said lead terminals have at least one bent part, said bent part being covered by said coating resin composition.

4. The electronic device of claim 2 wherein said lead terminals have at least one bent part, said bent part being covered by said coating resin composition.

5. The electronic device of claim 1 wherein said thermistor main body has a negative characteristic.

6. The electronic device of claim 2 wherein said thermistor main body has a negative characteristic.

7. The electronic device of claim 5 adapted to detect the temperature of a secondary battery pack comprising secondary batteries and a pack main body containing said secondary batteries.

8. The electronic device of claim 6 adapted to detect the temperature of a secondary battery pack comprising secondary batteries and a pack main body containing said secondary batteries.

9. The electronic device of claim 1 wherein said saturated copolymerized polyester resin has average numerical molecular weight of 18000–25000, tensile rupture strength 2 MPa–20 MPa, tensile rupture elongation 300%–1400%, and hardness 15 Shore D–60 Shore D.

10. The electronic device of claim 1 wherein said saturated copolymerized polyester resin has average numerical molecular weight of 15000–20000, tensile rupture strength 35 MPa–60 MPa, tensile rupture elongation 1%–10%, and hardness 65 Shore D–90 Shore D.

11. The electronic device of claim 1 wherein said saturated copolymerized polyester resin is a mixture of a first kind and a second kind, said first kind having average numerical molecular weight of 18000–25000, tensile rupture strength 2 MPa–20 MPa, tensile rupture elongation 300%–1400%, and hardness 15 Shore D–60 Shore D, and said second kind having average numerical molecular weight of 15000–20000, tensile rupture strength 35 MPa–60 MPa, tensile rupture elongation 1%–10%, and hardness 65 Shore D–90 Shore D.

12. The electronic device of claim 1 wherein said coating resin composition has tensile rupture strength 12 MPa–20 MPa, tensile elastic modulus 500 MPa–1200 MPa, tensile rupture elongation 3%–40%, and hardness 42 Shore D–50 Shore D.

13. The electronic device of claim 9 wherein said coating resin composition has tensile rupture strength 12 MPa–20 MPa, tensile elastic modulus 500 MPa–1200 MPa, tensile rupture elongation 3%–40%, and hardness 42 Shore D–50 Shore D.

14. The electronic device of claim 10 wherein said coating resin composition has tensile rupture strength 12 MPa–20 MPa, tensile elastic modulus 500 MPa–1200 MPa, tensile rupture elongation 3%–40%, and hardness 42 Shore D–50 Shore D.

15. The electronic device of claim 11 wherein said coating resin composition has tensile rupture strength 12 MPa–20 MPa, tensile elastic modulus 500 MPa–1200 MPa, tensile rupture elongation 3%–40%, and hardness 42 Shore D–50 Shore D.

16. The electronic device of claim 11 wherein said mixture contains 25–75 weight parts of said second kind and 100 weight parts of said first kind.

17. The electronic device of claim 15 wherein said mixture contains 25–75 weight parts of said second kind and 100 weight parts of said first kind.

18. The electronic device of claim 1 wherein said coating resin composition further contains 10–400 weight parts of an inorganic filler for 100 weight parts of said resin component, said inorganic filler containing one or more metallic compounds selected from the group consisting of silicon oxide, titanium oxide, aluminum oxide, talc, antimony trioxide, aluminum hydroxide and magnesium hydroxide.

19. The electronic device of claim 1 wherein said coating resin composition further contains 5–50 weight parts of an organic flame retardant for 100 weight parts of said resin component, said organic flame retardant being selected from hexabromobenzene, pentabromodiphenylethane, ammonium polyphosphate and polyphosphoric amide.

20. The electronic device of claim 18 wherein said coating resin composition further contains 5–50 weight parts of an organic flame retardant for 100 weight parts of said resin component, said organic flame retardant being selected from hexabromobenzene, pentabromodiphenylethane, ammonium polyphosphate and polyphosphoric amide.

* * * * *